US005227571A

United States Patent [19]

Cipriani

[11] Patent Number: 5,227,571

[45] Date of Patent: Jul. 13, 1993

[54] GUITAR SADDLE HAVING AN INCLINED LEVER PORTION

[76] Inventor: Thomas P. Cipriani, Lincoln Bay Apartments, 1441 Lincoln Rd., Apt. 411, Miami Beach, Fla. 33139

[21] Appl. No.: 802,369

[22] Filed: Dec. 4, 1991

Related U.S. Application Data

[60] Division of Ser. No. 446,215, Dec. 5, 1989, Pat. No. 5,092,213, which is a continuation-in-part of Ser. No. 213,157, Jun. 29, 1988, Pat. No. 4,951,543, which is a continuation-in-part of Ser. No. 39,941, Apr. 20, 1987, abandoned.

[51] Int. Cl.[5] ..... G10D 3/04

[52] U.S. Cl. ..... 84/307; 84/298

[58] Field of Search ..... 84/298, 297 R, 297 S, 84/295, 307, 308, 309

[56] References Cited

U.S. PATENT DOCUMENTS

| | | | |
|---|---|---|---|
| 104,324 | 6/1870 | Knox | 84/295 |
| 712,550 | 11/1902 | Kriwulka | 84/295 |
| 4,332,184 | 6/1982 | Phillips | 84/297 R |
| 4,646,613 | 3/1987 | Banchetti | 84/297 R |
| 4,656,915 | 4/1987 | Osuga | 84/298 |
| 4,951,543 | 8/1990 | Cipriani | 84/298 |
| 5,092,213 | 3/1992 | Cipriani | 84/297 R |

*Primary Examiner*—Michael L. Gellner
*Assistant Examiner*—Cassandra Spyrou
*Attorney, Agent, or Firm*—Ladas & Parry

[57] ABSTRACT

A bridge assembly for a guitar in which a saddle is mounted on the body of the guitar for contact with the strings extending longitudinally above the body of the guitar for holding the strings above the body of the guitar under tension and producing a double change in angle of the strings on the saddle. The saddle has a fulcrum end supported on the guitar from which an inclined lever portion extends at an acute angle with respect to the body of the guitar and has a free end on which the string passes and applies force to the saddle. The inclined lever portion defines a tapered space with the body of the guitar so that the applied double force of the string is transmitted via the inclined lever portion to its fulcrum end forwardly at the acute angle. For bass strings, the saddle can be formed with multiple angularly spaced legs and for treble strings with a solid, triangular cross section.

20 Claims, 7 Drawing Sheets

GUITAR SADDLE HAVING AN INCLINED LEVER PORTION

CROSS RELATED APPLICATIONS

This is a divisional of copending application(s) Ser. No. 07/446,215 filed on Dec. 5, 1989 now U.S. Pat. No. 5,092,213 which is a continuation-in-part of Ser. No. 07/213,157 filed on Jun. 29, 1988 now Pat. No. 4,951,543 which is a continuation-in-part of Ser. No. 07/039,941 now abandon filed Apr. 20, 1987.

FIELD OF THE INVENTION

The invention relates to acoustical stringed instruments and particularly to the construction of a bridge assembly and a string anchor system for a guitar.

BACKGROUND AND PRIOR ART

In my earlier applications, I have disclosed a number of constructions for bridge assemblies to increase volume and sustain of a vibrating string of a guitar. These constructions embody the principle of raising the strings of the guitar above the soundboard by a saddle of a bridge and separating the push force acting on the saddle from the pull force acting on the string anchor. The separation of the push and pull forces has been achieved by providing a notch in the bridge supporting the saddle to form a hinge or fulcrum between the string anchor and the portion of the saddle which is contacted by the string.

In further study, I have found that additional factors are involved in maximizing volume and sustain of the vibrating strings and in separating the push and pull forces and their application to the sound board of the guitar. These include direction of application of the force of the string at its anchor and manner and direction of transfer of the string force to the saddle.

SUMMARY OF THE INVENTION

An object of the present invention is to provide improvements in a guitar construction by which a vibrating string will produce increased volume and sustain in a simple and efficient manner.

A further object of the invention is to provide a bridge construction which satisfies these requirements.

Another object of the invention is to provide a novel anchoring system for the strings of the guitar by which the desired results are obtained.

Yet another object of the invention is to provide a modified arrangement of the neck of the guitar to maintain the strings at substantially the same height above the fret board on the neck even though the strings are raised different heights above the sound board by the bridge.

In order to achieve separation of the push and pull forces acting on the sound board by the strings, the invention provides a saddle member comprising an inclined lever element extending at an acute angle with respect to the body of the guitar, said inclined lever element having a fulcrum end supported on the guitar and a free end on which the string passes to the anchor and applies force to the saddle member. The inclined lever element defines a tapered space with the body of the guitar so that the applied force of the string on the inclined lever element is transmitted to the fulcrum end of the saddle member forwardly at said acute angle.

In accordance with the invention, the string contacts the saddle member at least at two points and undergoes two angle changes in passing to the string anchor. In this way, after the string makes its first contact with the saddle member (which establishes the "string length") the string acts as a short "wire" which imparts to the string amplified vibration due to its inherent stiffness.

In further accordance with the invention, the string extends from the inclined lever element to the string anchor in a direction substantially perpendicular to the body of the guitar.

According to a feature of the invention particularly applicable to bass strings, the saddle member comprises a plurality of projecting legs extending from the fulcrum end in angularly spaced relation from one another.

For treble strings, the saddle member has a solid triangular cross section and bears against an upstanding wall of the saddle member while its apex portion is adjustably mounted in one of a succession of grooves in the bridge.

In further accordance with the invention, a string contact element is mounted on the saddle member by friction means for allowing longitudinal adjustment of the string contact element on the saddle member for string length fine tuning.

By virtue of the construction of the saddle member according to the invention, the bass strings are held a distance of between ¾ and 1 ½ inches above the body of the guitar and the treble strings are held at a distance of between ½ inch and 1 inch above the body of the guitar. These distances are considerably greater than those of conventional guitars.

In further accordance with the invention, the treble and bass strings are held above the body of the guitar at different heights which progressively increase according to the pitch of the strings from the treble strings to the bass strings and the fret board of the guitar is angularly tilted relative to the sound board so that the strings all extend at substantially the same height above the fret board.

The invention also contemplates a construction for anchor means for attachment of the ends of the strings to the body of the guitar at a distance thereabove.

In order to insure separation of the push and pull forces, the invention further contemplates the formation of a hinge or fulcrum between the fulcrum end of the inclined lever element and the string anchor means. In a particular embodiment, the hinge or fulcrum is formed by a notch in the bridge extending from a front face of the bridge to an intermediate location between the fulcrum end of the inclined lever element and the string anchor.

DETAILED DESCRIPTION OF PREFERRED EMBODIMENTS

Figures 1, 13:
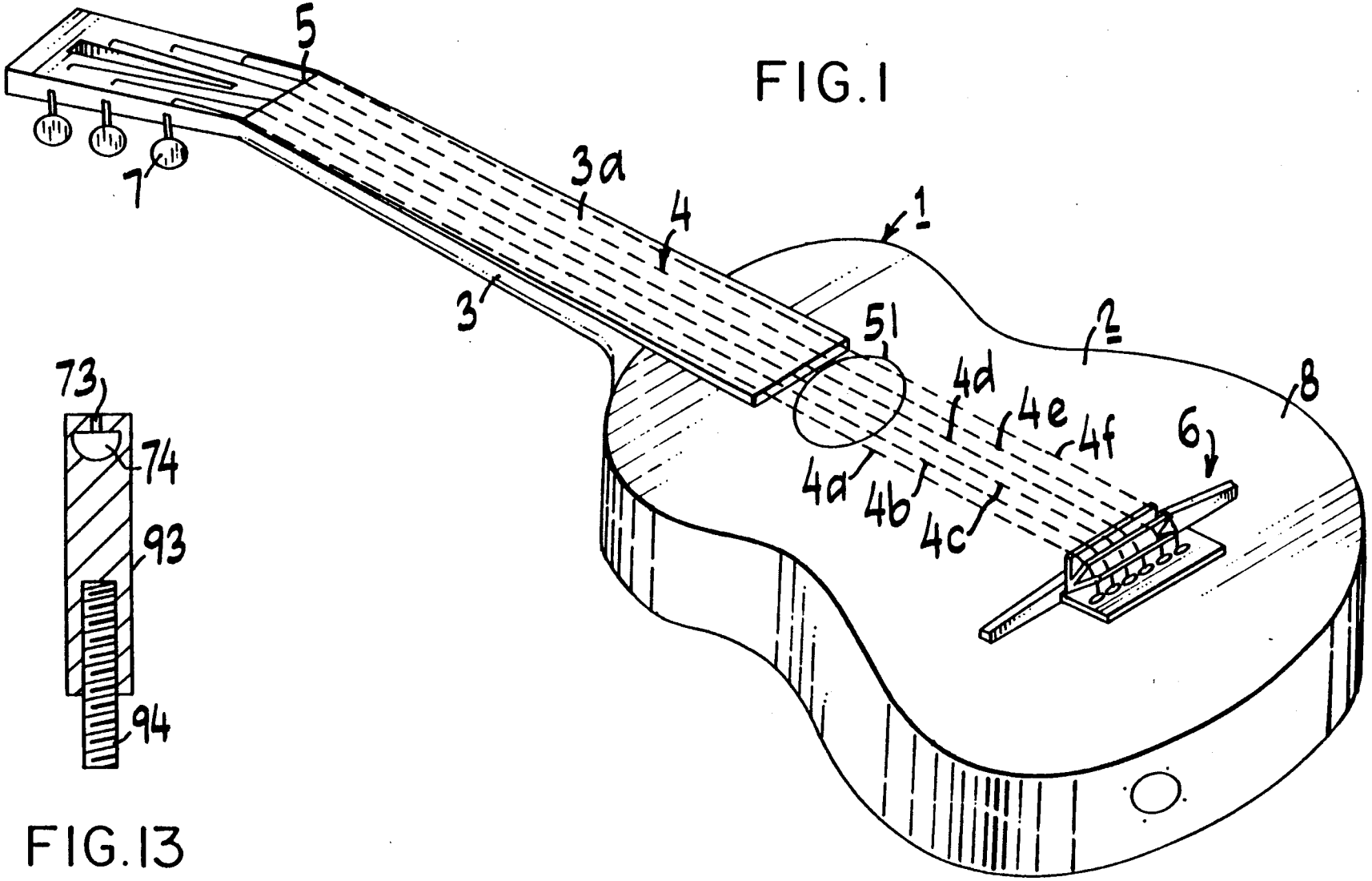
FIG. 1 is a top perspective view of a guitar showing a bridge assembly according to the invention.
FIG. 13 shows a further embodiment of a string anchor.

Referring to the drawing, FIG. 1 shows a guitar 1 including a body 2 from which extends a neck 3 which supports a fret board 3*a* thereon and above which extend a plurality of strings 4 between a nut 5 and a bridge assembly 6. The tension in the strings is adjusted by means of tuning keys 7 placed at the head of the guitar. The body 2 includes a vibratable sound board including a cover 8 over a resonating box 9 having acoustical properties.

The strings 4 are generally six in number and constitute bass strings and treble strings. The bass strings are heavier in diameter and are generally composed of a core and a spiral winding on the core whereas the treble strings usually are monofilaments of nylon or steel wire. Normally there are three base strings and three treble strings but this may vary. The strings are designated 4*a*–4*f* proceeding from the lowest bass register to the highest treble register.

Figure 3:
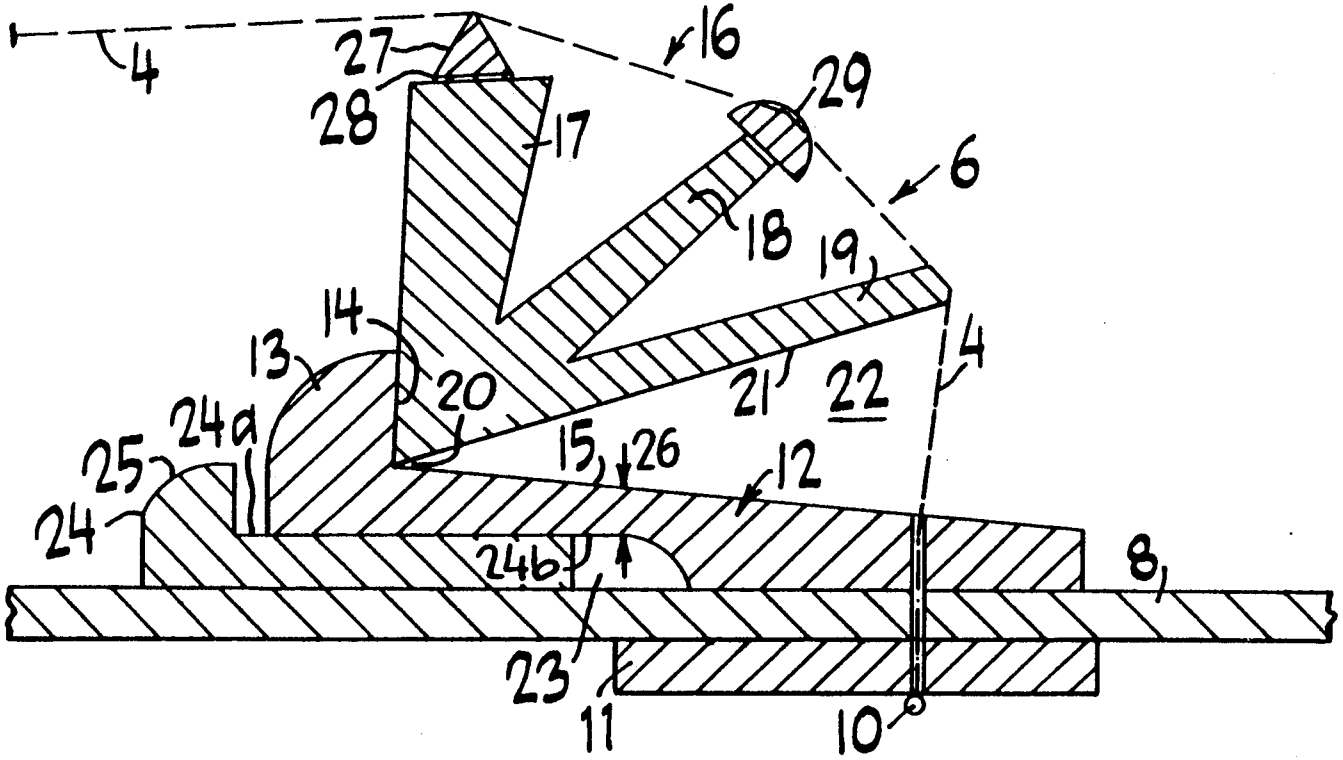
FIG. 3 is an enlarged transverse sectional view through the bridge assembly of the invention.

The strings extend longitudinally above the body of the guitar and contact the bridge assembly 6 which holds the strings above the body of the guitar under tension and produces a change in angle of the strings. After leaving the bridge assembly, the strings are attached to the body of the guitar at anchors 10. As seen in FIG. 3, anchors 10 are engaged beneath a reinforcing structure 11 secured in the resonating box to the cover 8.

The bridge assembly 6 comprises a bridge or base member 12 which is fixed to the upper surface of the cover 8 by gluing. At the front of the bridge 12 is an upstanding wall 13 having a planar back face 14. The bridge 12 has an upper surface 15 which forms an angle with the surface 14, generally a right angle. Mounted on the bridge 12 is a saddle 16 on which strings 4 pass from the nut 5 to the anchors 10. The saddle 16 holds the strings above the body of the guitar in a tensioned condition.

The string length of guitars has been established generally at 25 9/16 inches. This is the distance from the point of contact at the edge of the nut to the point of first contact of the string with the saddle. In order to produce a louder sound with this established string length, the bridge assembly according to the invention raises the height of the strings above the cover 8 by an amount substantially exceeding the conventional constructions. Conventionally, the bass strings extend above the cover by ⅜ to ½ inch, and the treble strings extend ⅜ of an inch above the cover. The bridge assembly according to the invention raises the height of the bass strings to a value between ¾ and 1½ inches and the treble strings to a height of ½ to 1 inch above the cover. The bridge assembly according to the invention is constructed not only to hold the strings at these elevated distances above the cover but additionally to distribute the greater forces produced due to the greater height in a way which will further increase the volume and the sustain of the strings.

For the above purpose, the saddle 16 comprises a plurality of legs 17, 18, 19 which extend from a fulcrum end 20 of the saddle in angularly spaced relation from one another. The string 4 extends from a substantially horizontal position above the sound board cover at the left of leg 17 and passes on the saddle 16 (where its direction is changed three times) and it is secured to the cover 8 at anchor 10. The string applies force to the legs 17, 18 and 19 as it undergoes change of angle thereat, and the construction of the saddle is such that the forces which are applied to the legs are transmitted axially along the legs to the fulcrum end 20. The fulcrum end 20 is supported on the bridge 12 and the forces in the legs are transmitted to the bridge and therefrom to the body of the guitar. The vertical component of the forces at fulcrum end 20 acts in a downward or push direction on the cover 8 while the tension in the string at anchor 10 acts in a pull or upwards direction on cover 8. In accordance with the invention, these push and pull forces are separated to a maximum degree to maximize the volume and sustain of the string when it is vibrated.

In order to insure the separation of the push and pull forces, the lower surface 21 of leg 19 is disconnected from and spaced above the surface 15 of the bridge 12 to form a free space 22 therewith so that the lower surface 21 remains out of contact with any support. In this way, the saddle 16 forms an inclined lever element extending at an acute angle with respect to the body of the guitar and its fulcrum end 20 is supported on the guitar while the string passes on the free end of the saddle and applies force to the saddle. For stability, the saddle can be secured to the surface 14 of the bridge by glue. The angle of the tapered space 22 can vary between about 1° and 40° for bass strings and between 1° and 60° for treble strings to achieve the separation of the push and pull forces with stability. Furthermore, since the saddle is out of contact with bridge 12 except at its fulcrum end, the damping effect normally produced by the relatively soft wood of bridge 12 on the string vibration is eliminated.

Because the string undergoes at least two changes of angle on the saddle member from its horizontal position above the body of the guitar to its anchor 10, and because these angle changes take place over a relatively short length (compared to the length of the string from its tuning peg to its first contact point with leg 17) the stiffness of the string produces an elastic force due to bending of the string which increases the vibrational frequency of the string when vibrated, as well as increasing the volume and sustain. In order to increase the stiffness of the string between its first contact point with leg 17 and its anchor at 10, thereby to amplify the effect due to its transverse rigidity and bending capability, the string can be locally thickened between its first contact point with leg 17 and its anchor at 10. This can be achieved in a number of ways as given hereinafter:

a) enlarge the core of the string, b) enlarge the diameter of the wire which wraps around the core, c) wrap the wire more than once around the core, and d) double the string and wrap it around itself. The local increase in thickness of the string will also strengthen the string in the region of maximum stress.

In a further feature of the invention, the length of leg 19 is such that when the string leaves leg 19 for attachment at anchor 10, the string extends substantially perpendicularly to the surface of cover 8. This not only results in a substantially perpendicular pull force on the cover 8 but maximizes the resonating effect in the resonating box 9. It is advantageous for the string even to extend beyond the perpendicular by an amount up to 5°.

Although three legs 17–19 have been illustrated in FIG. 3, it is also possible to form the saddle 16 with only two legs or with more than three legs. The significant features which must be observed are that the force applied to the saddle will result from two angular changes of the string and the force be transmitted through the inclined lever element to the fulcrum end 20 axially of the legs while additionally the string will exit from the inclined lever portion for attachment at the anchor 10 substantially at right angles to the cover 8.

In order to insure separation between the push and pull forces, the bridge 12 is provided with a notch 23 extending from the front surface of front wall 13 to a position between the anchor 10 and the fulcrum end 20 of the saddle to form a hinge or fulcrum in the bridge which will keep the push and pull forces separated. A wedge 24 is inserted into the notch 23 in tight relation between the bridge 12 and the cover 8. Hence the force applied by the string to the saddle 16 is transmitted through the inclined lever element to the fulcrum end 20 and thereat to the cover 8 via the bridge 12 and wedge 24. A residual space can be left in the notch 23 between the anchor 10 and the fulcrum end 20. The wedge 24 has an upstanding lip 25 which facilitates removal of the wedge. The lip also rigidifies the bridge and acts as a force transfer member and transmit vibrational energy to the extremes of the treble and bass sides of the sound board. The wedge is not limited to be made of one piece or to be of symmetrical shape.

In order to develop the hinge or fulcrum effect for the bridge, the notch 23 is dimensioned so that the remaining thickness of the bridge as shown at 26 is between 1/32 and 3/32 inches depending on the material of the bridge. In addition to distributing the string force to the cover 8, the wedge 24 also has a tuning function and its degree of insertion into the notch 23 affects the resonant sound. Although parallel surfaces have been shown for the upper surface **24*a* of the wedge and the surface 24*b* of the bridge 12 at the notch, these can be slightly inclined so that an interference fit is obtained as the wedge is inserted into the notch. The wedge is not permanently secured to the top of the cover 8** so that it can be removed and replaced with a larger wedge to compensate for ageing or warping of the sound board.

The saddle, bridge and wedge can be made of many suitable materials, including but not limited to, wood, aluminum, titanium, ivory, graphite composites or carbon fiber composites, ceramics, quartz, synthetic resins, ceramic matrix composites, ceramics made of silicon nitride, ceramic silicon composites, material with superconductive properties, metal matrix composites reinforced with ceramic fibers and metal alloys.

In order to achieve the desired separation of push and pull forces and appropriate transmission of forces from the saddle to the sound board cover, the longitudinal distance between the anchor 10 and the surface 14 at which the saddle 16 bears should be between ½ and 1¼ inches.

In order to permit string length fine tuning by adjusting the initial contact point of the string with the saddle, an adjustment member 27 is mounted at the top of leg 17 and is adjustably supported on leg 17 through the intermediary of a friction layer 28. Consequently, the adjustment member 27 can be adjusted longitudinally on leg 17 by movement on the friction layer. In a particularly effective embodiment, the friction layer 28 is formed by placement of a layer of sandpaper at the top of leg 17. In order to provide good frictional contact between the string 4 and the saddle 16, a friction member 29 made of relatively soft material, such as lead, is secured at the end of leg 18. The string 4 therefore will "bite" into the soft material of member 29 to lock the string to the saddle.

Figure 4:
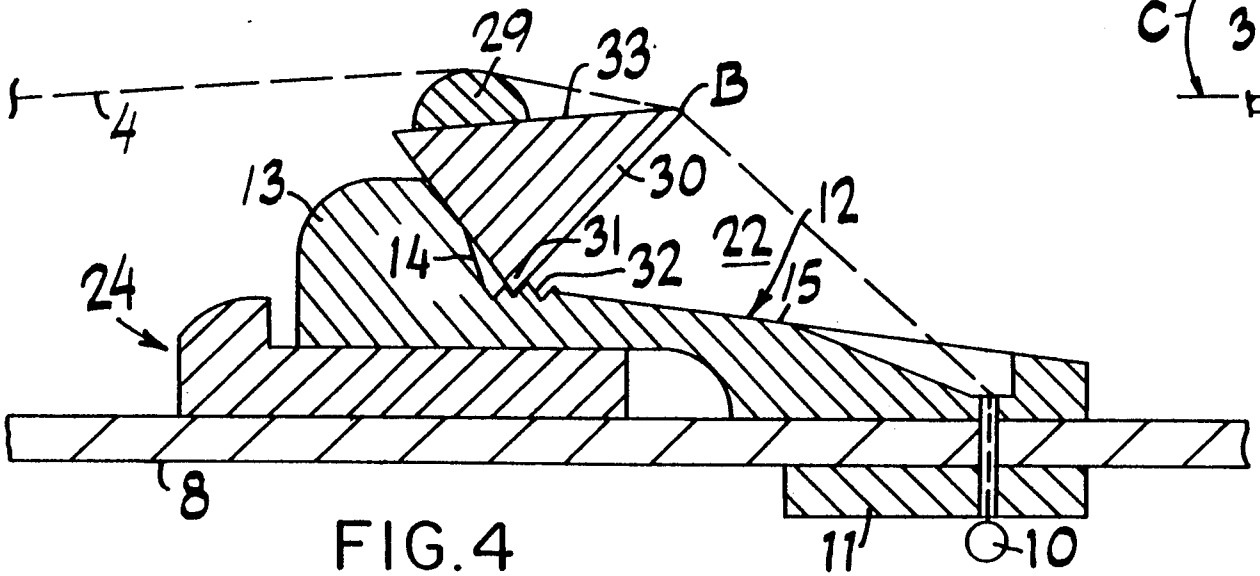
FIGS. 4–7 are views similar to FIG. 3 for other embodiments of the bridge assembly.

The embodiment shown in FIG. 3 is especially effective for the bass strings. However, for the treble strings where less friction is developed between the string and the saddle, the embodiment of FIG. 4 is preferred. In this embodiment, the saddle 30 is of solid, triangular cross-sectional shape and its apex portion 31 forms the fulcrum end for the saddle. The apex portion 31 is engaged selectively in one of a succession of grooves 32 located in the upper surface 15 of the bridge 12 near the surface 14 of front wall 13. A friction member 29 is secured to the upper surface 33 of the triangular saddle 30. The string 4 contacts the friction member 29 at point A and then contacts apex B of saddle 30 whereat the string changes direction and travels to its anchorage at anchor 10 at the bottom of the reinforcing structure 11 beneath the cover 8. The transmittal of forces applied to the triangular saddle 30 in FIG. 4 is similar to that in FIG. 3. Namely, the force applied to the saddle at point B is transmitted through the triangular cross section of saddle 30, acting as an inclined lever element, to the fulcrum end constituted by the apex portion 31 and therefrom to the bridge 12 and cover 8. The tapered triangular space 22 formed between the saddle 30 and the surface 15 of the bridge insures that the forces applied to the saddle will be transmitted to the fulcrum end and thence through the bridge 12 and wedge 24 to the sound board cover 8 which maximizes the separation between the push and pull forces acting on the sound board cover. By maximizing the separation between the push and pull forces, the torque applied to the body of the instrument (product of push and pull forces times the separation distance therebetween) is also maximized and in order to maintain maximized torque, no push forces should be applied to the bridge near the anchor as these push forces would cancel the pull force of the string at the anchor.

In FIG. 4 the treble strings leave point B of the saddle and extend at an acute angle to the anchor 10. However, the treble strings can also be arranged to connect to the anchor in an orientation substantially perpendicular to the sound board cover as described for the bass strings in FIG. 3. For this purpose, 1) the anchor 10 in FIG. 4 can be moved closer to the saddle 30, 2) the surface 14 can be moved closer to the anchor 10, 3) the saddle 30 can be increased in length longitudinally.

In any of the above constructions, it is required that the fulcrum formed on the bridge 12 be located between the apex portion 31 and anchor 10 and, if necessary, the fulcrum can be relocated to satisfy this requirement.

Figure 2:
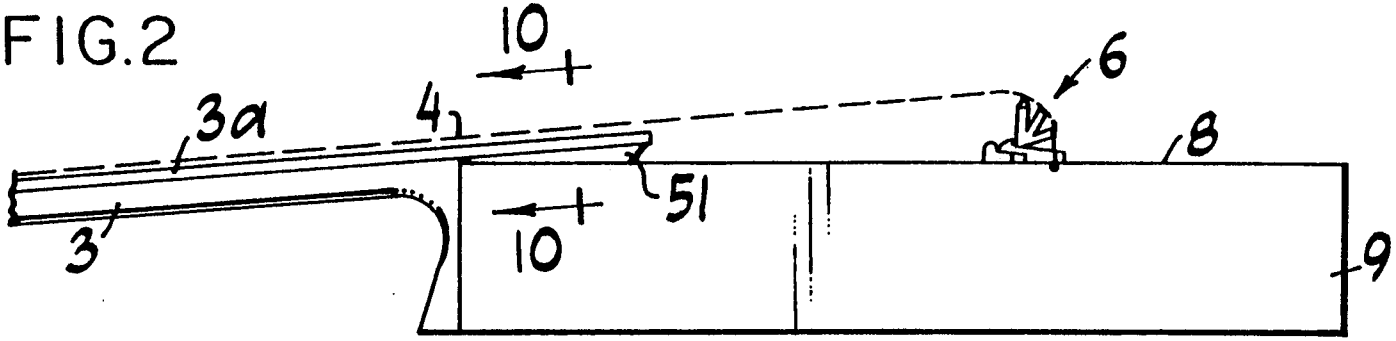
FIG. 2 is a side elevational view of the guitar in FIG. 1.
Figure 5:
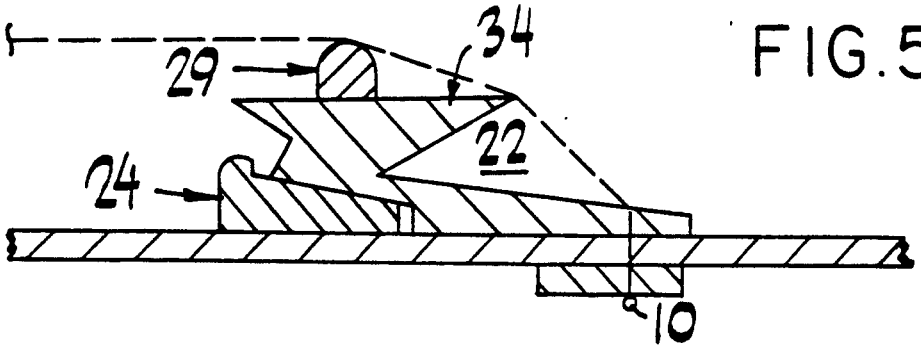
Figure 6:
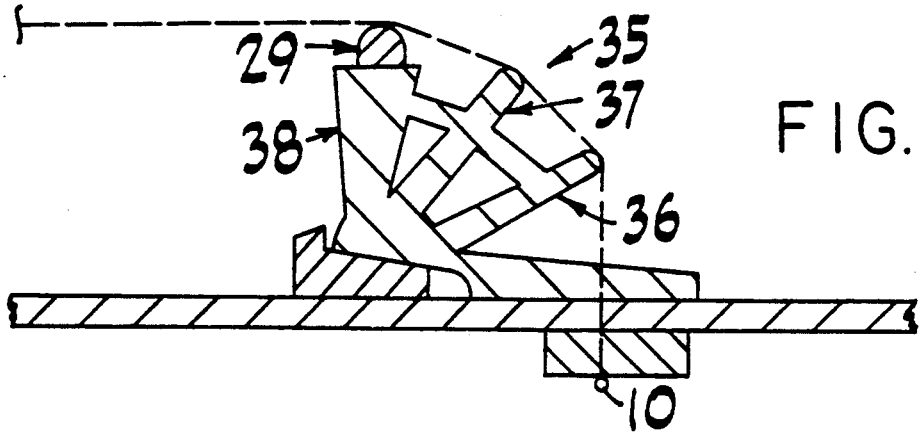
Figure 7:
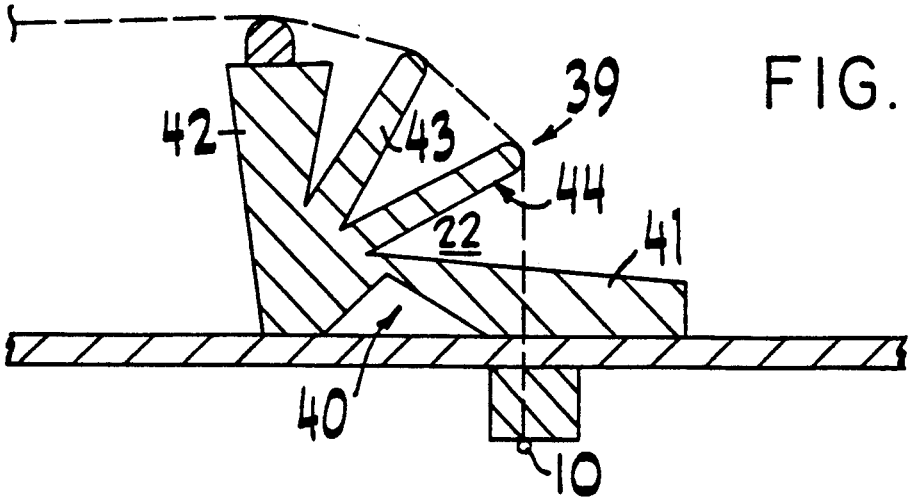

In FIG. 2, a single saddle is shown for the six strings, but the saddle can be divided into individual saddle members one for each string or one for two or more strings. Preferably, a separate saddle, base member and string length fine tuning adjustment member is provided for each string so that string length fine tuning can be individually effected for each string. The saddle shown in FIG. 4 can be used for the treble strings while the saddle shown in FIG. 3 for the bass strings. Other modifications of the saddle are shown in FIGS. 5–7. In FIG. 5 the saddle 34 is formed integrally with the bridge. This embodiment, however, maintains the inclined lever element with the tapered space 22 to effect the transmission of the applied string force to the fulcrum end forwardly at the acute angle of the inclined lever element. The remaining elements which are common to the earlier described embodiments have the same reference numerals. FIG. 6 shows a modification of the embodiment in FIG. 5 and instead of a solid triangular shaped saddle as shown in FIG. 5, the saddle 35 in FIG. 6 is formed with a plurality of interconnected legs 36–38. This embodiment is lighter in weight than the embodiment in FIG. 5. Additionally, it should be seen that the exit angle of the string from the saddle can be made substantially vertical in the embodiment of FIG. 6 (suitable for bass strings) whereas in FIG. 5 the string angle is inclined from the vertical (suitable for treble strings). FIG. 7 shows another embodiment in which saddle 39 is an integration of the bridge and the saddle elements. In this embodiment, the wedge has been eliminated and in order to provide the fulcrum or hinge between the push and pull forces, a triangular notch 40 has been formed in the undersurface of base portion 41 of saddle 39. The saddle 39 includes three legs 42–44 which extend from the fulcrum end of the saddle at an angle with respect to one another to form an inclined lever element defining space 22.

Figure 8:
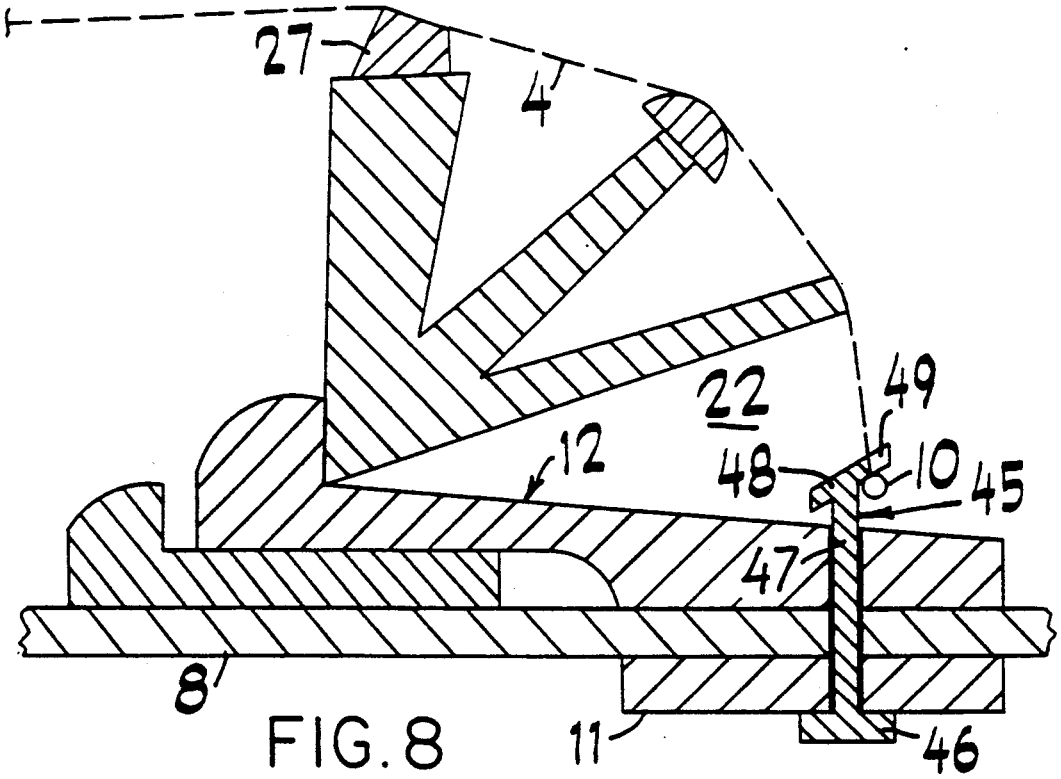
FIG. 8 is a view similar to FIG. 3 with a modified string anchor.

FIG. 8 shows a modification of the embodiment in FIG. 3 in which the anchor 10 of the string is not directly secured beneath the reinforcing structure 11 but rather is affixed to an anchor member 45 which extends above the bridge 12 into the space 22. The anchor member 45 has a retainer flange 46 at its lower end which abuts against the bottom surface of reinforcing structure 11 and a web 47 which extends through openings provided in the reinforcing structure 11, the cover 8 and the bridge 12. At the top of the web, a support plate 48 is secured and extends transversely along the bridge 12 over the width of the strings. The plate 48 is provided with a slit 49 for each string so that the anchor 10 of each string is below the corresponding slit 49 and cannot pass upwardly therethrough. In assembly, the plate 48 is secured on the web 47, by gluing or fasteners, after the bridge 12 has been glued to the top surface of the cover 8. When the strings are engaged to the anchor member 45 under tension, they pull the retainer flange 46 against the reinforcing structure 11. Replacement of the strings is simplified by this construction as it is only necessary to slide the string through the slit 49 to free anchor 10 to enable removal of the string and to reverse the procedure for a replacement string.

Figure 11:
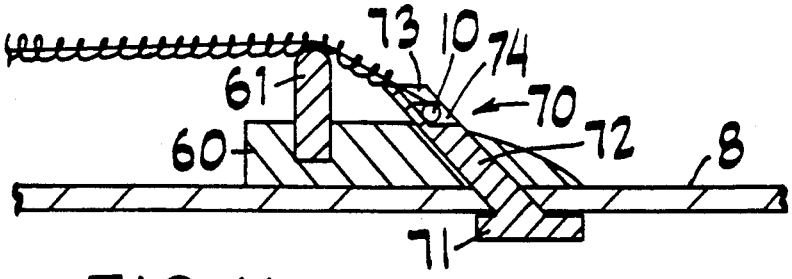
FIG. 11 is a sectional view of another embodiment of a string anchor.
Figure 12:
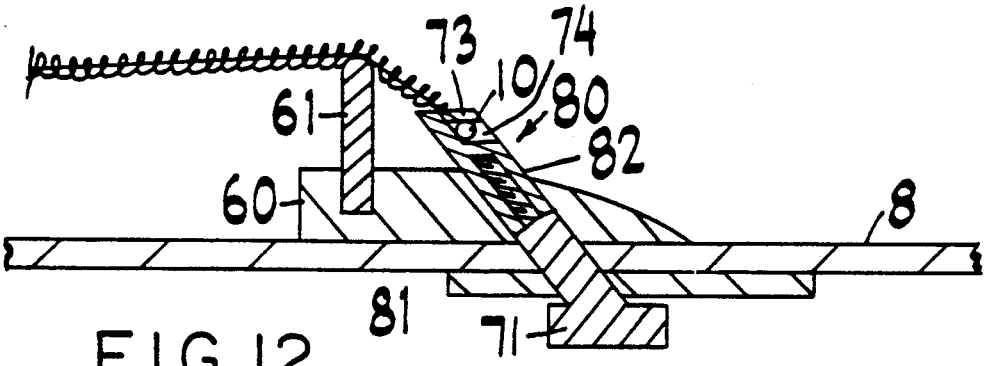
FIG. 12 is a sectional view of a further embodiment of a string anchor.
Figure 14:
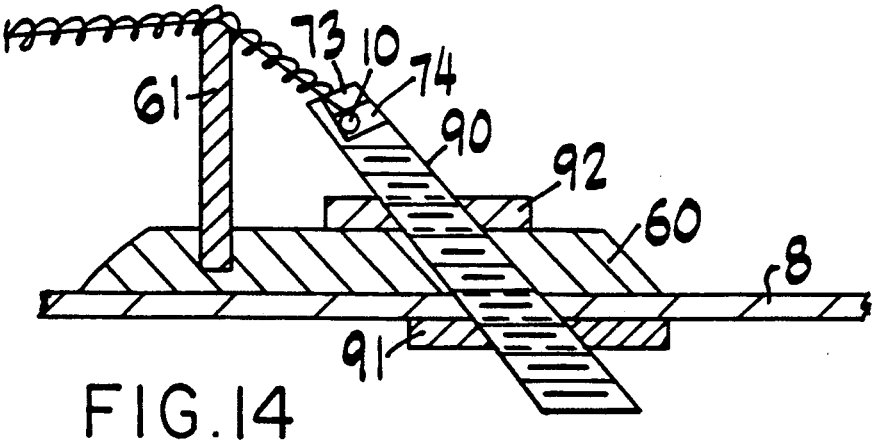
FIG. 14 is a sectional view showing the mounting of the anchor in FIG. 13 on a bridge.

Instead of a single anchor member for all six strings, each string can have a respective independent anchor member as will be described later. Although the anchor member 45 is particularly effective in combination with the saddle member of the invention, it has also been found effective for use with conventional bridges and saddles. This is shown in FIGS. 11–14. In these figures there is seen a conventional bridge 60 secured to the cover 8 and a saddle 61 is mounted in the bridge 60. The string is anchored after it passes on the saddle. In FIG. 11, anchor member 70 is an integral element having a retainer flange 71 beneath the cover and an inclined web 72 extending through and above bridge 60. The upper end of the web 72 is formed with a plurality of slits 73, one for each string, and the slits extend to a notch 74 in which the anchors 10 of the strings can be retained. FIG. 12 shows a modification in which each string has a respective anchor member 80 formed by male and female portions 81, 82 which are threadably engaged. This enables the anchor point on the female portion 82 to be adjusted in height above the sound board cover 8. FIG. 14 show a further embodiment in which a threaded anchor 90 engages a threaded retainer 91 secured to the underside of the cover 8. By turning anchor 90 around its axis the anchor 90 can be raised or lowered along an inclined line to raise or lower the anchor 10 of the string. A lock nut 92 can be threaded onto anchor 90 until it abuts against the top surface of bridge 60. FIG. 13 shows a modification of the threaded anchor 90 in FIG. 14 and comprises a female body 93 receiving a threaded stud 94 which can engage retainer 91.

Figure 9:
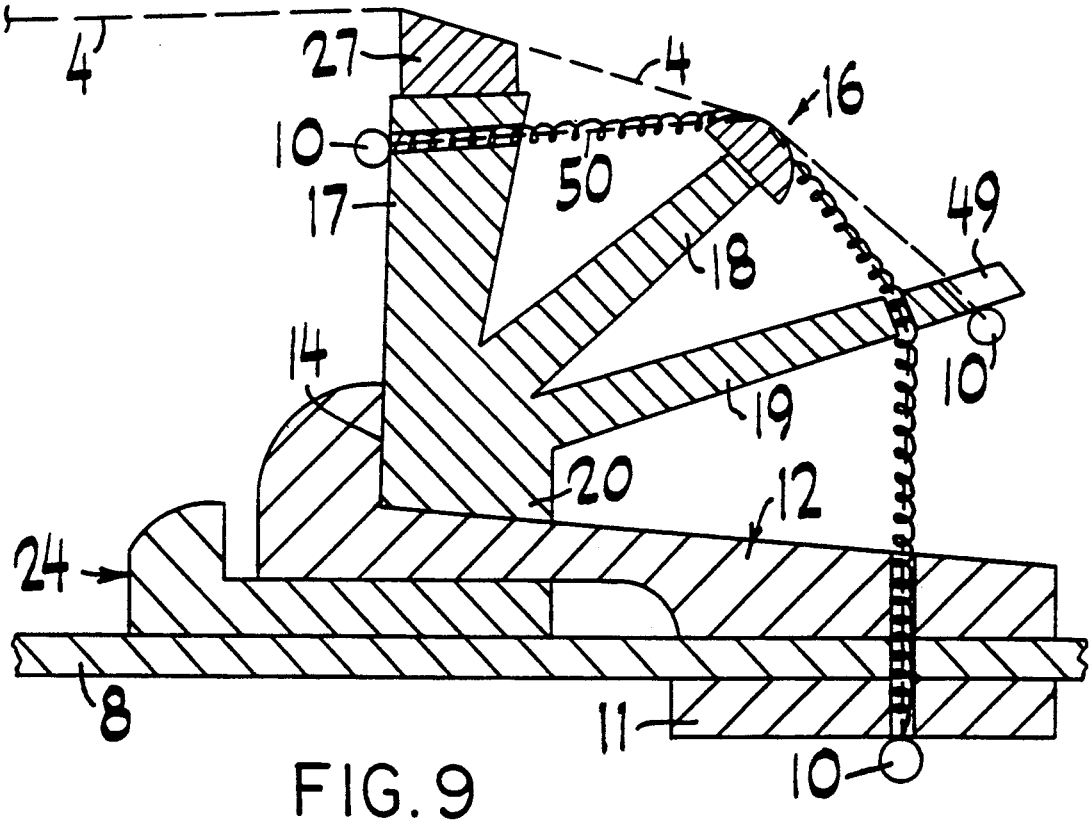
FIG. 9 is a view similar to FIG. 8 with another embodiment of the string anchor.

In an another arrangement, as shown in FIG. 9, the anchor 10 of string 4 can be directly secured to the leg 19 of the saddle 16 by providing a slit 49 in the upper end of leg 19. An auxiliary string 50 is then secured to the saddle 16 and to the reinforcing structure 11 under the sound board cover 8. One or more auxiliary strings 50 may be employed to transmit the forces from the saddle 16 to the sound board cover. The string 50 can be a heavy string similar to a bass string consisting of a core and a winding in order to provide good friction between the string 50 and the legs of the saddle. In this embodiment, the pull force of the string is not directly transmitted to the sound board cover but is transmitted first to the saddle and then to the sound board cover through the auxiliary string 50. The force applied to the saddle due to change in direction of the string is transmitted, as in the previous embodiments, to the fulcrum end 20 for distribution to the sound board cover through the bridge 12 and the wedge 24. It is particularly notable that the auxiliary string 50 extends to the anchor 10 at the reinforcing structure 11 at an angle substantially perpendicular to the sound board cover. This is of particular significance for the treble strings in the embodiment of FIG. 4, as this arrangement represents another way of changing the acute angle at which the strings attach to the sound board cover to substantially a right angle. The anchor 10 on the auxiliary string 50 at leg 17 preferably is adjustable on the string in order to adjust the tension in string 50.

Figure 15:
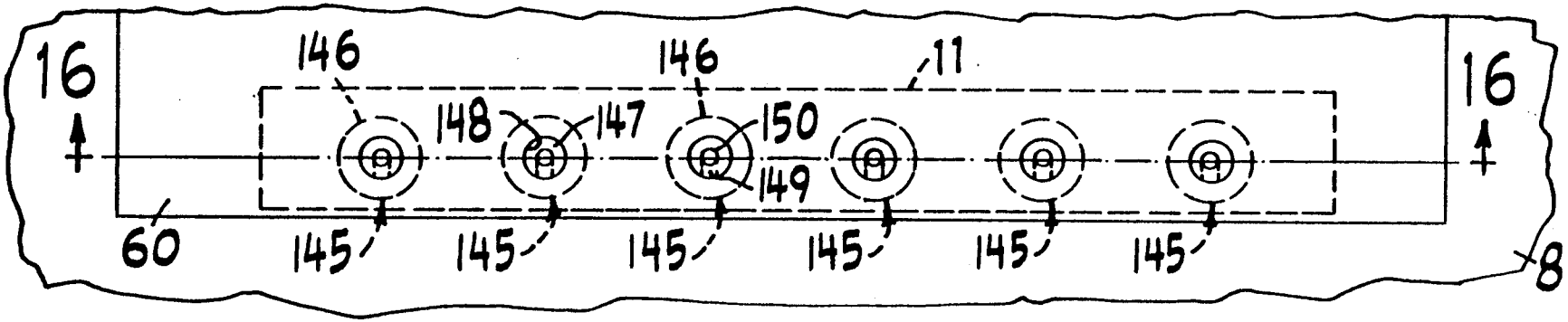
FIG. 15 is a top view of a modified arrangement of a string anchor system.
Figure 16:
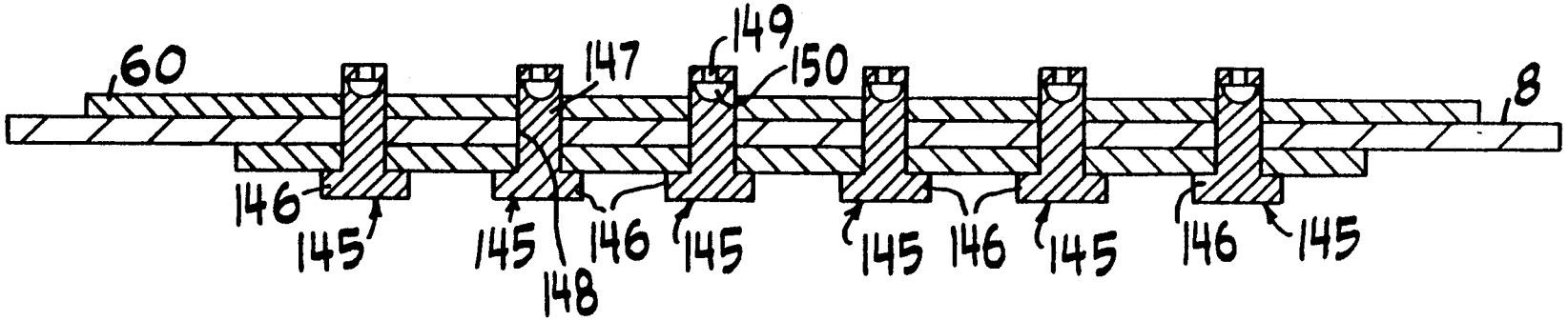
FIG. 16 is a sectional view taken on line 16—16 in FIG. 15.

FIG. 15 shows an arrangement in which a respective anchor 145 is provided for each string. Each anchor 145 includes a lower flange 146 mounted beneath the reinforcing structure 11 and a rod 147 which extends through a bore 148 formed in the reinforcing structure 11, the sound board cover 8 and the bridge 60. At the top of rod 147 is a slit 149 through which the string can pass so that the anchor 10 at the end of the string can be seated in a hemispherical recess 150. Preferably, the flange 146 of each anchor is secured to the reinforcing structure 11, for example, by glue. The diameter of rod 147 is between $\frac{1}{8}''$ and $\frac{1}{4}''$ to minimize the material cut out from the cover 8.

Figure 10:
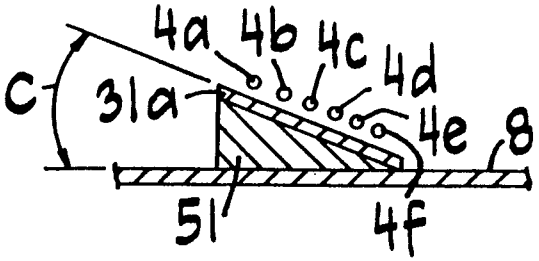
FIG. 10 is a sectional view taken on line 10—10 in FIG. 2 for a modified embodiment of the neck.

Because of the different properties in material and thickness, the bass strings can be raised substantially higher than the treble strings and maintain an improved sound quality. Each string has its own optimum bridge height, and as previously noted, the bass strings produce the best sound when raised to a height between ¾ and 1½ inches whereas the three treble strings should be between ½ and 1 inch above the body of the guitar. Ideally, each string will be supported by a respective bridge member which will hold the string at its ideal height above the sound board cover. In such an arrangement, however, when the strings pass over the fret board 3*a* of a conventional neck 3, the strings will be at different heights above the fret board. This is undesirable and musicians prefer that the strings be at equal heights above the fret board 3*a*. In order to achieve this, the neck is adapted to the saddle and as shown in FIG. 10 in exaggerated manner, the fret board forms an angle C with the cover 8 of the resonating box. This angle will normally be between 50 and 150. The angularity of the fret board is achieved by a spacer 51 of triangular cross section. The spacer 51 is interposed between the fret board 3*a* and the sound board cover 8. If the upper surface of the neck is maintained coplanar with the upper surface of the sound board cover as conventional, the spacer 51 will extend between the neck and the fret board towards the nut 5. The spacer 51 is tapered longitudinally along the length of the fret board towards the nut 5 whereat the strings all contact the nut. Alternatively, the neck itself can be tilted and the spacer 51 limited to interposition between the cover 8 and the fret board. Although the upper surface of the fret board is shown flat in FIG. 10, it can be made slightly convex, especially for steel strings.

Although the invention has been described in relation to specific embodiments thereof, it will be become apparent to those skilled in the art that numerous modifications and variations can be made within the scope and spirit of the invention as defined in the attached claims.

What is claimed is:

1. A bridge assembly for a string musical instrument comprising a bridge mountable on a body of a musical instrument, a saddle member mounted on said bridge for contact with a string extending longitudinally above the body of the musical instrument for holding the string above said body under tension and producing at least two changes in angle of the string on the saddle member, said saddle member comprising an inclined lever element extending at an acute angle with respect to said body and having a fulcrum end supported by said bridge and a free end on which the string passes and undergoes change of angle to apply force to the saddle member, said inclined lever element having a lower surface facing said bridge, said lower surface, apart from said fulcrum end, being disconnected from said bridge to define an open space therebetween so that the applied force of the string is transmitted via said inclined lever element to said fulcrum end forwardly at said acute angle.

2. A bridge assembly for a musical instrument as claimed in claim 1 comprising anchor means for securing said string with respect to the body of the musical instrument after the string has passed on said inclined lever element.

3. A bridge assembly for a musical instrument as claimed in claim 2 wherein said string extends to said anchor means substantially perpendicularly with respect to the body of the musical instrument.

4. A bridge assembly for a musical instrument as claimed in claim 1 wherein said saddle member comprises a plurality of projecting legs extending from said fulcrum end in angularly spaced relation from one another.

5. A bridge assembly for a musical instrument as claimed in claim 1 wherein said bridge has a notch therein between said fulcrum end of the inclined lever element and said anchor means.

6. A bridge assembly for a musical instrument as claimed in claim 1 wherein said saddle member and said bridge are integral.

7. A bridge assembly for a musical instrument as claimed in claim 1 wherein said bridge includes an upstanding wall against which said saddle member abuts.

8. A bridge assembly for a musical instrument as claimed in claim 1 wherein said saddle member has a triangular cross-section.

9. A bridge assembly for a musical instrument as claimed in claim 8 wherein said bridge has a succession of grooves, said saddle member having an apex portion adjustably mounted in one of said grooves.

10. A bridge assembly for a musical instrument as claimed in claim 1 wherein at least one of said bridge and saddle member is composed of a composite of graphite or carbon fibers, quartz, titanium, aluminum, wood, ivory, synthetic resins, ceramic matrix composites, ceramics made of silicon nitride, ceramic silicon composites, materials that have superconductive properties, metal matrix composites reinforced with ceramic fibers, or metal alloys.

11. A bridge assembly for a musical instrument as claimed in claim 1 comprising a string contact element on said saddle member and means between said string contact element and said saddle member for adjusting a position of said string contact element on said saddle member.

12. A bridge assembly for a musical instrument as claimed in claim 1, wherein for bass strings said saddle member has a height to hold said string a distance between ¾ and 1 ½" above the body of the musical instrument and for treble strings said saddle member has a height to hold said string a distance of between ½" and 1" above the body of the musical instrument.

13. A bridge assembly for a musical instrument as claimed in claim 1 wherein said string passes on the free end of the inclined lever element and is anchored to said saddle member, and further comprising an auxiliary string secured to said saddle member and said body of the musical instrument and passing on said inclined lever element.

14. A bridge assembly for a musical instrument as claimed in claim 1 wherein the body of the musical instrument has a vibratable sound board cover on which the bridge assembly is mounted, a neck extending from the body, a fret board on said neck and string tuning means on the neck, the musical instrument having a multiplicity of strings including bass strings and treble strings, and saddle member holding the strings above said cover at different heights which progressively increase according to diminishing pitch of the strings from the treble strings to the bass strings, said strings extending from the tuning means over the fret board to the saddle member, and means for holding said fret board in angularly tilted relation relative to said cover so that the strings all extend at substantially the same height above the fret board.

15. A bridge assembly for a musical instrument as claimed in claim 1 comprising anchor means secured to the body of the musical instrument including an anchor member extending above said body for anchoring an end of the string above said body of the musical instrument.

16. A bridge assembly for a musical instrument as claimed in claim 15, wherein said anchor member extends above said bridge.

17. A bridge assembly for a musical instrument as claimed in claim 1 wherein said bridge has a front face with a notch extending from said front face rearwardly of the bridge, and a wedge member in said notch, said wedge member including a transverse lip.

18. An anchor for a string of a stringed musical instrument having a resonating box provided with a vibratable sound board cover thereon, a plurality of strings extending longitudinally above the sound board cover, a bridge on said resonating box, a saddle member on said bridge, said strings passing on said saddle member in stretched condition, tuning means remote from the bridge for varying the tension in the strings, and anchor means for anchoring the strings to the instrument after said strings have passed on said saddle member, said anchor means comprising an auxiliary anchoring string, each of said strings of the musical instrument being secured to said saddle member, said auxiliary anchoring string being secured to said saddle member and to said resonating box and extending on and over the saddle member under tension.

19. A bridge assembly for a musical instrument as claimed in claim 1, wherein said bridge is fixedly mountable on said body of the musical instrument, said bridge including means for holding the saddle member thereon and preventing forward movement of the saddle member longitudinally of the string.

20. A bridge assembly for a musical instrument as claimed in claim 19, wherein said means on said bridge for holding the saddle member comprises an upstanding wall engaging said saddle member.

* * * * *